US009102387B2

(12) United States Patent
Rossini

(10) Patent No.: US 9,102,387 B2
(45) Date of Patent: Aug. 11, 2015

(54) SUBMERSIBLE LIGHTING SYSTEM FOR SMALL WATERCRAFT

(71) Applicant: I-LUMENATE, LLC., Winston-Salem, NC (US)

(72) Inventor: William Thomas Rossini, Kings Mountain, NC (US)

(73) Assignee: I-Lumenate, LLC, Winston-Salem, NC (US)

( * ) Notice: Subject to any disclaimer, the term of this patent is extended or adjusted under 35 U.S.C. 154(b) by 127 days.

(21) Appl. No.: 13/659,787

(22) Filed: Oct. 24, 2012

(65) Prior Publication Data

US 2014/0078760 A1 Mar. 20, 2014

Related U.S. Application Data

(60) Provisional application No. 61/628,057, filed on Oct. 24, 2011, provisional application No. 61/629,092, filed on Nov. 14, 2011.

(51) Int. Cl.
*B60Q 1/02* (2006.01)
*B63B 45/02* (2006.01)

(52) U.S. Cl.
CPC ..... *B63B 45/02* (2013.01)

(58) Field of Classification Search
USPC ..... 362/101, 217.01, 223–225, 240, 362/249.01, 249.02, 276, 418, 436, 477, 362/540, 545, 640; 114/343
See application file for complete search history.

(56) References Cited

U.S. PATENT DOCUMENTS

| | | | | | |
|---|---|---|---|---|---|
| 4,475,301 | A * | 10/1984 | Wortham | 43/17.5 |
| 4,548,148 | A * | 10/1985 | Bloomfield, III | 114/66 |
| 5,119,277 | A | 6/1992 | Copley et al. | |
| 5,136,484 | A * | 8/1992 | Eaton | 362/485 |
| 5,513,080 | A | 4/1996 | Magle et al. | |
| 5,738,432 | A | 4/1998 | Okko et al. | |
| 6,050,213 | A | 4/2000 | Stevens | |
| 6,273,588 | B1 * | 8/2001 | Arakelian | 362/267 |
| 6,315,424 | B1 * | 11/2001 | Hui | 362/22 |
| 6,431,733 | B2 | 8/2002 | Seifert et al. | |
| 6,572,424 | B2 | 6/2003 | Harkrider | |
| 6,840,190 | B2 | 1/2005 | Godek | |
| 6,874,920 | B2 | 4/2005 | Huffman et al. | |
| 6,964,243 | B1 | 11/2005 | Thompson | |
| 7,028,629 | B2 * | 4/2006 | Walcome | 114/173 |
| 7,232,243 | B1 | 6/2007 | Nassif | |
| 7,238,075 | B2 | 7/2007 | Brodsky | |
| 7,448,780 | B2 * | 11/2008 | Hurley | 362/477 |
| 7,708,289 | B2 | 5/2010 | Jaime, Sr. | |
| 7,861,661 | B2 | 1/2011 | Beaty | |
| 8,083,238 | B2 | 12/2011 | Borges | |
| 2006/0176686 | A1 * | 8/2006 | McVicker | 362/183 |
| 2007/0251441 | A1 * | 11/2007 | Herndon | 114/343 |

* cited by examiner

*Primary Examiner* — Hargobind S Sawhney
(74) *Attorney, Agent, or Firm* — James D. Wright; David R. Higgins; Tillman Wright, PLLC

(57) ABSTRACT

An underwater light-equipped watercraft system includes a watercraft and a removable submersible lighting system. The lighting system includes a harness and a light unit coupled to the harness. The watercraft has a bottom surface that is disposed underwater when the watercraft is used in the water. The harness is removably mounted around at least a portion of the watercraft such that the light unit is disposed against the bottom surface of the watercraft.

20 Claims, 18 Drawing Sheets

10

SUBMERSIBLE LIGHTING SYSTEM FOR SMALL WATERCRAFT

CROSS-REFERENCE TO RELATED APPLICATION

The present application is a U.S. nonprovisional patent application of, and claims priority under 35 U.S.C. §119(e) to, each of: (1) U.S. provisional patent application Ser. No. 61/628,057, filed Oct. 24, 2011, and (2) U.S. provisional patent application Ser. No. 61/629,092, filed Nov. 14, 2011, each of which provisional patent applications is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

1. Field of the Present Invention

The present invention relates generally to submersible lighting systems, and, in particular, to submersible lighting systems for small watercraft such as surfboards, paddleboards, sailboards, kayaks, canoes, and rafts.

2. Background

A wide variety of small watercraft are known to exist, and their popularity continues to increase. Many of these are powered by mechanical engine, but others are powered only by the manual efforts of their riders or by the forces of nature, i.e. by paddle, wind, wave, or the like. Watercraft of the latter category include surfboards, paddleboards, sailboards, kayaks, canoes, rafts, and the like.

The use of small watercraft becomes more dangerous and less enjoyable in conditions of low or no light, particularly at night. A variety of lighting systems have been developed for larger watercraft, but most are not suitable for use with smaller watercraft because of their size, the way they are mounted or carried by the watercraft, or their inability to be used in a submerged environment. One of the few attachable light systems known for use with powered watercraft is disclosed in U.S. Pat. No. 6,874,920, but is specifically designed for use with a boat motor, and is generally unsuitable for use with small unpowered watercraft.

Lighting systems for use in or with surfboards are disclosed in U.S. Pat. No. 7,238,075 and, to a lesser extent, in U.S. Pat. No. 8,083,238. However, such systems are intended to make the surfboard (or other board) visible, rather than illuminating the water beneath the surfboard. Further, such systems must be integrated into the surfboard itself, rather than being removably attached in a way that does not affect the integrity of the surfboard or other watercraft.

Thus, a need exists for a submersible lighting system that may attached to a small watercraft, such as a surfboard, a paddleboard, a sailboard, a kayak, a canoe, a raft, or the like, and subsequently removed, without affecting the integrity of the watercraft, and that illuminates the water beneath or adjacent the watercraft to facilitate viewing marine life, improving navigation, and enhancing the safety of the user and those around him or her.

SUMMARY OF THE PRESENT INVENTION

Broadly defined, the present invention according to one aspect is an underwater light-equipped watercraft system, including: a watercraft having a bottom surface that is disposed underwater when the watercraft is used in the water; and a removable submersible lighting system, having a harness and a light unit coupled to the harness, wherein the harness is removably mounted around at least a portion of the watercraft such that the light unit is disposed against the bottom surface of the watercraft.

In a feature of this aspect, the watercraft further has a top surface, and wherein the harness is removably mounted around the top surface of the watercraft. In further features, the harness includes one or more straps, and the harness is removably mounted around the top surface of the watercraft by extending the one or more straps around the top surface of the watercraft; and each of the one or more straps includes a length of polypropylene webbing. In still further features, the removable submersible lighting system further comprises a power supply system providing electricity to the light unit; the power supply system includes a controller, operable to turn the light unit on and off, disposed on the top surface of the watercraft; the controller is electrically connected to the light unit via at least one electrical wire carried by the harness from the controller to the light unit; and/or the watercraft is a surfboard, a kayak, a paddleboard, or a sailboard.

In another feature of this aspect, the light unit includes an elongated body whose long axis is oriented along the length of the watercraft. In a further feature, the elongated body of the light unit includes two opposed ends, and wherein each of the two opposed ends is coupled to the harness. In still further features, the watercraft includes a side, wherein the bottom surface of the watercraft defines a centerline, wherein the elongated body of the light unit is disposed between the centerline and the side of the watercraft, and wherein the elongated body of the light unit is disposed closer to the side of the watercraft than to the centerline; and wherein the side of the watercraft is a port side, wherein the light unit is a first light unit and is disposed adjacent the port side of the watercraft, wherein the watercraft further includes a starboard side, and wherein the lighting system includes a second light unit that is disposed adjacent the starboard side of the watercraft, closer to the starboard side of the watercraft than to the centerline. In still further features, the light unit includes a light strip extending along the long axis of the elongated body; the elongated body includes a channel extending along its long axis, wherein the light strip is disposed within the channel; and/or the light strip includes a row of LED lights covered by a hard clear coat.

In another feature of this aspect, the harness includes one or more strap sections forming a single continuous loop around the watercraft, wherein the lighting system includes two light units carried entirely by the single continuous loop, and wherein the two light units are separated from one another such that one light unit is disposed adjacent a port side of the watercraft and the other light unit is disposed adjacent a starboard side of the watercraft.

Broadly defined, the present invention according to another aspect is a submersible lighting system for small watercraft, including: a harness; a light unit coupled to the harness; and a power supply system providing electricity to the light unit; wherein the harness is adapted to be removably mounted around at least a portion of a watercraft such that the light unit is disposed against the bottom surface of the watercraft.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
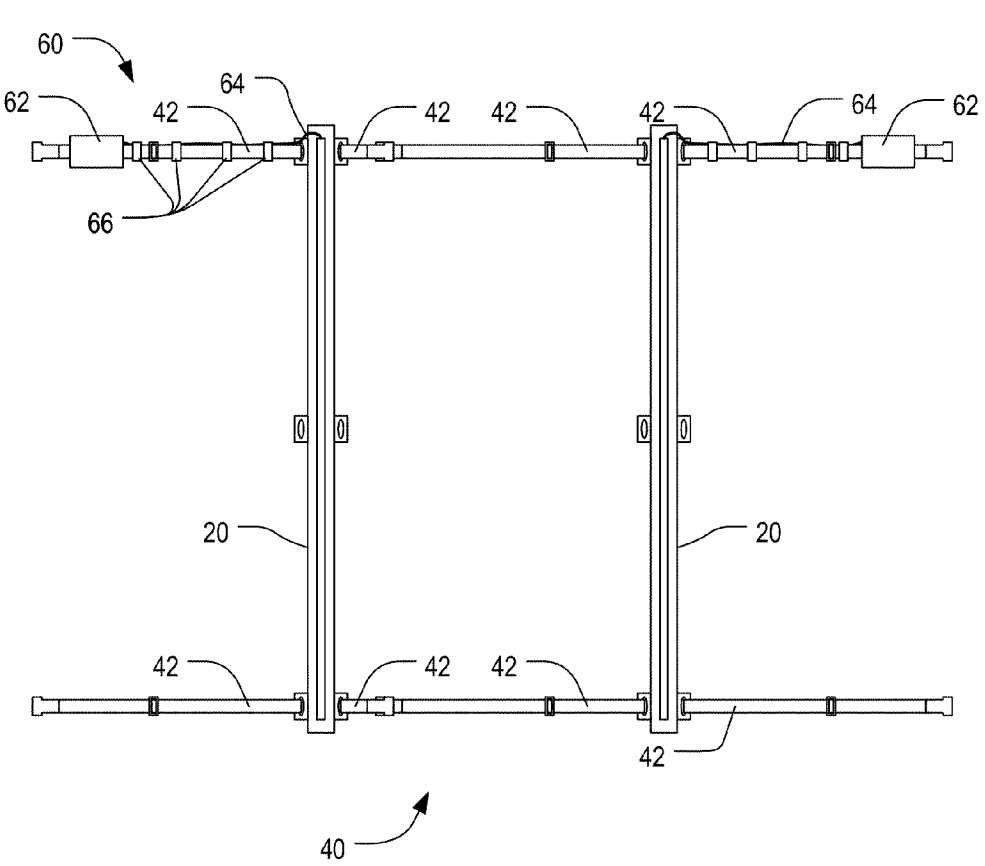
FIG. 1 is a partially schematic top view of a submersible lighting system for small watercraft in accordance with a first preferred embodiment of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiments is merely exemplary in nature and is in no way intended to limit the invention, its implementations, or uses.

FIG. 1 is a partially schematic top view of a submersible lighting system 10 for small watercraft in accordance with a first preferred embodiment of the present invention. As shown therein, the lighting system 10 includes a pair of light units 20, a harness 40, and a pair of power supply systems 60. Each of these elements will be described in greater detail hereinbelow.

Figure 2:
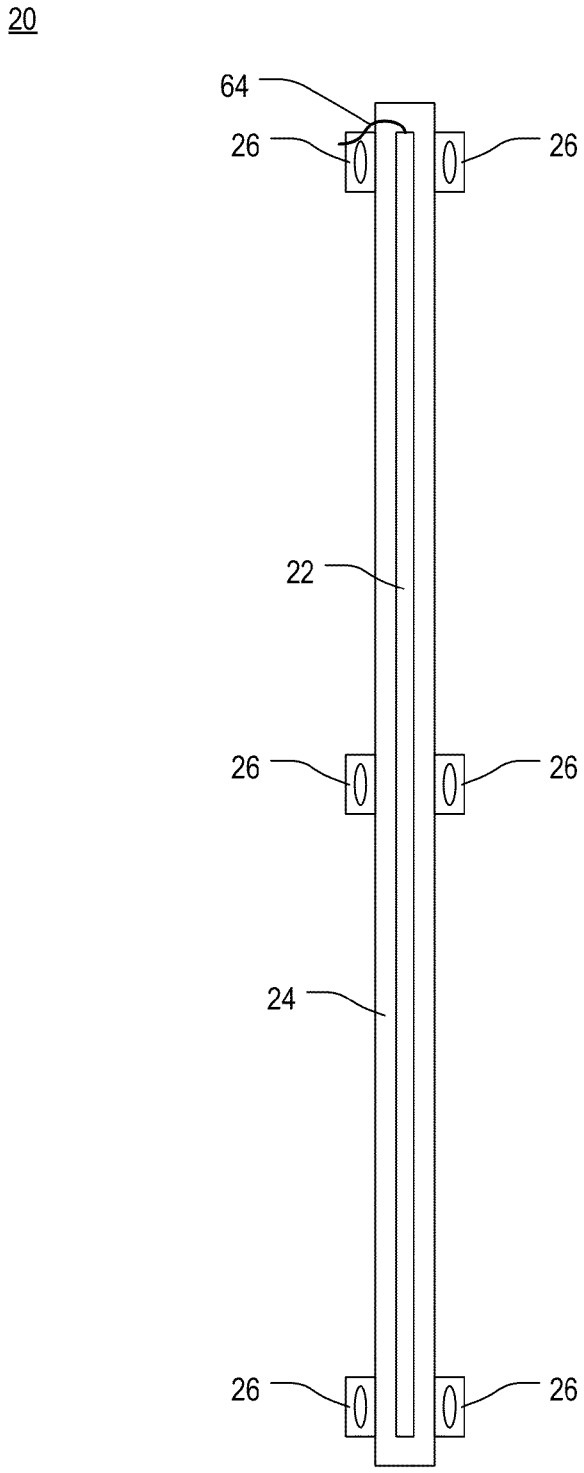
FIG. 2 is an enlarged partially schematic top view of one of the light units of FIG. 1.
Figure 3:
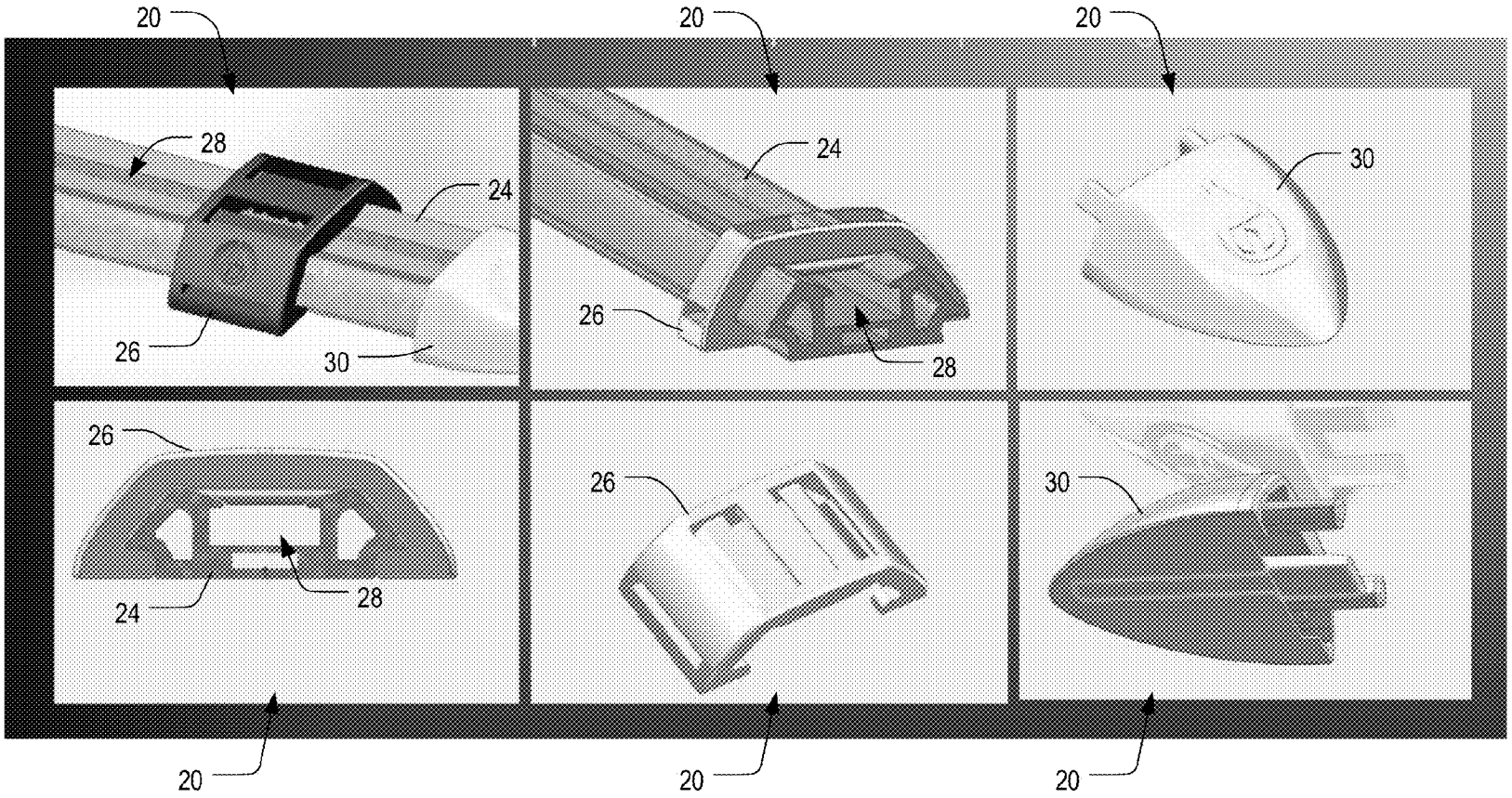
FIG. 3 is a set of fragmentary perspective views of portions of the rail of FIG. 2.
Figure 4A:
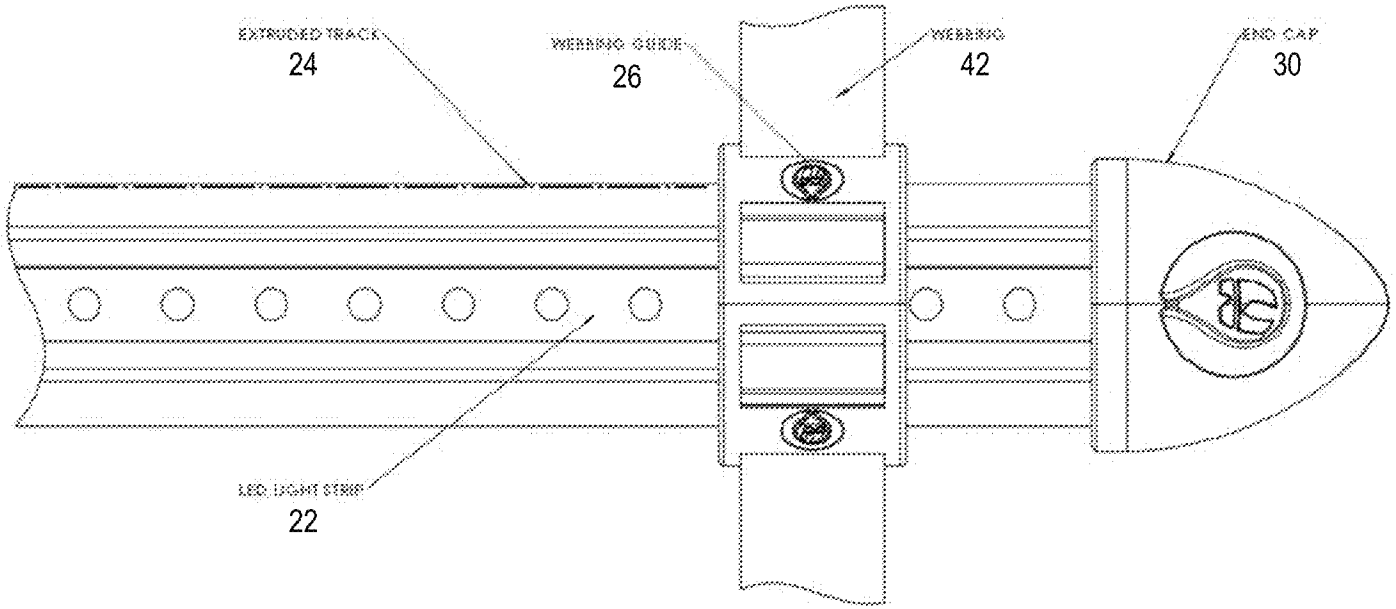
FIG. 4A is a fragmentary top view of a portion of the submersible lighting system of FIG. 1.
Figure 4B:
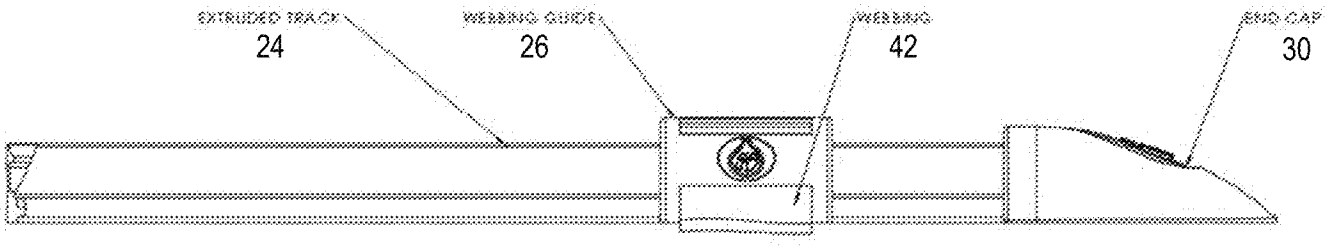
FIG. 4B is a fragmentary side view of the portion of the submersible lighting system of FIG. 4A.
Figure 4C:
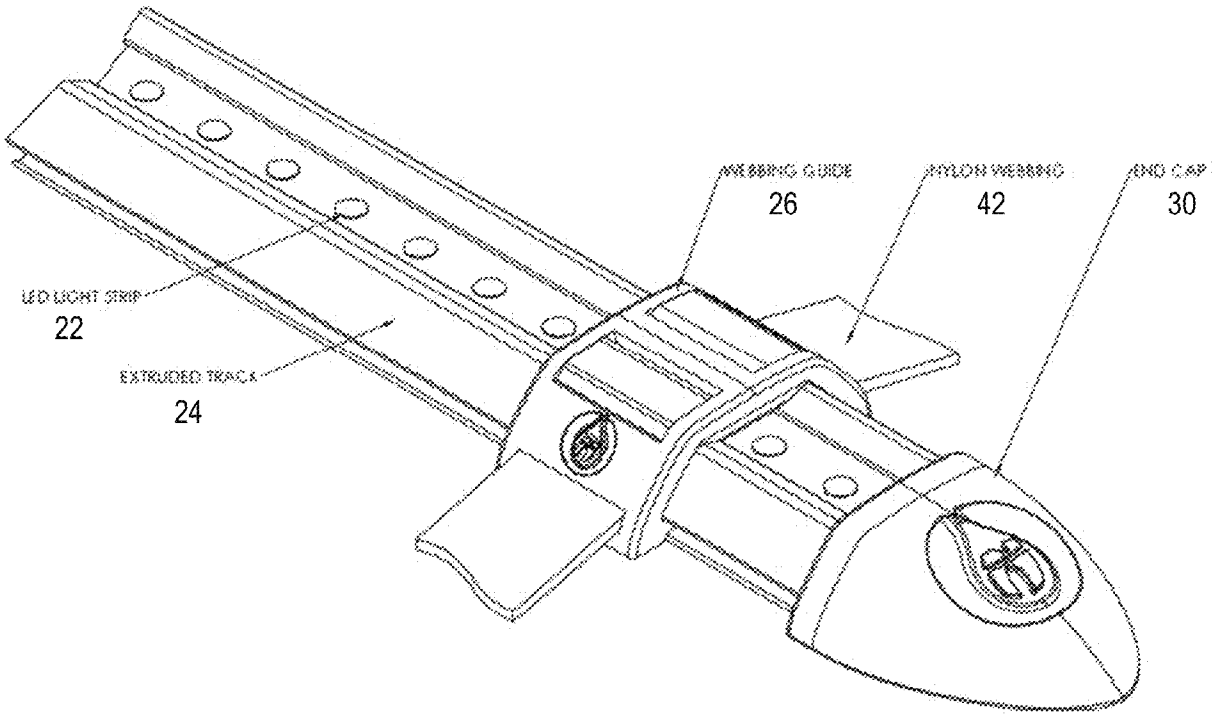
FIG. 4C is a fragmentary isometric view of the portion of the submersible lighting system of FIG. 4A.
Figure 4D:
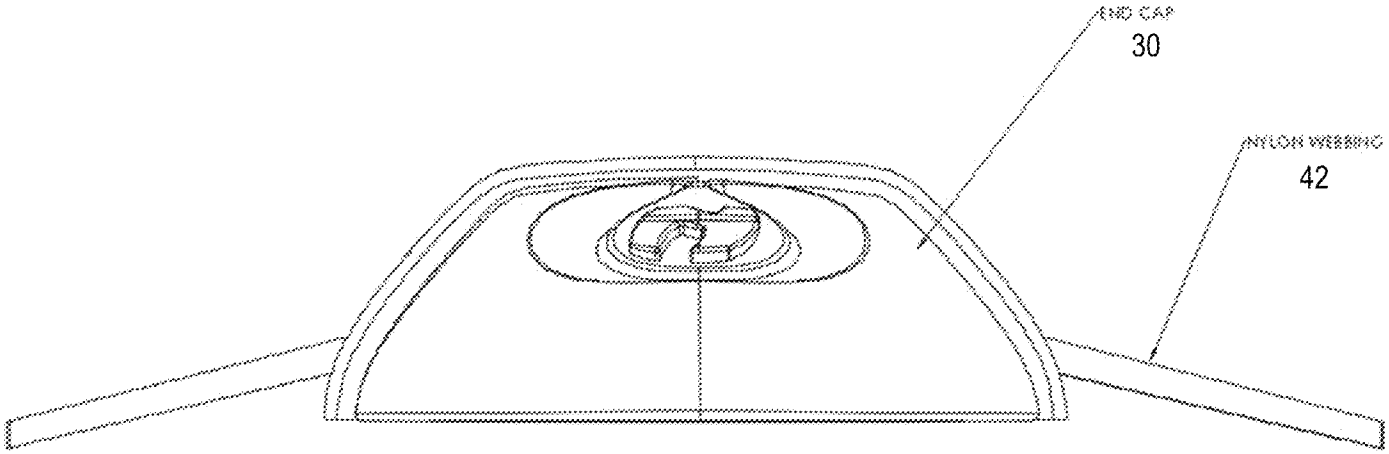
FIG. 4D is a fragmentary end view of the portion of the submersible lighting system of FIG. 4A.

FIG. 2 is an enlarged partially schematic top view of one of the light units 20 of FIG. 1. Each light unit 20 includes a light strip 22 carried by or upon an elongated rail 24 having a plurality of harness attachment points 26. FIG. 3 is a set of fragmentary perspective views of portions of the rail 24 of FIG. 2, and FIGS. 4A-4D are fragmentary views of a portion of the submersible lighting system of FIG. 1. In order to better retain and protect the light strip 22, the rail 24 preferably includes a channel 28 for receiving the light strip 22. In at least some embodiments, the rail 24 is semi-rigid so as to be fit or molded to the gentle curves typically found on the bottom of small watercraft 12, and is produced from plastic or aluminum in a conventional extrusion process. Plastic molded parts 30 may be used to cover and protect the ends of each rail and to help retain the light strip within the channel. In at least some embodiments, such molded parts may be integrated with the harness attachment points. In one contemplated commercial embodiment, the rail 24 is approximately 46 inches long, 2 inches wide, and 1 inch thick. However, it will be appreciated that a variety of different dimensions are acceptable.

The harness attachment points 26 are preferably rings that may be rigidly (or semi-rigidly) attached or integrally formed with the rest of the rail 24, or may be flexibly or rotatably coupled to the rail 24. Alternatively, however, the harness attachment points 26 may be clips, openings, buckles, or the like.

The light strip 22 is a long, slender waterproof light source that provides relatively uniform distribution of light along its length. In at least one embodiment, the light strip 22 utilizes a long row of LED lights covered by a hard clear coat. The size of the light strip 22 corresponds to that of the channel of the rail 24. In some embodiments, the light produced is a bright white light, but other colors of light may be produced in other embodiments.

Each power supply system 60 includes a battery 62, a controller (not shown), a power cable 64, and a plurality of strap attachment features 66 to couple the battery 62 and cable 64 to the harness 40. The battery 62 provides the power required by one of the light strips. In some other embodiments, a single battery may be used to power both light strips, but the use of two batteries makes it possible to separate the system into two separate subsystems as further described hereinbelow. The batteries 62 may be alkali batteries, lithium ion batteries, nickel-metal hydride batteries, or the like. Each battery 62 is preferably waterproof and/or is contained within a watertight container, and has a waterproof connector to the power cable 64. The battery 62 is carried on harness 40 by one or more sleeve, strap, or the like that may be incorporated into the harness design. In at least some embodiments, the battery 62 is easily removable or detachable from the harness 40 in order to facilitate recharging or replacement. The power cable 64 is routed from the battery 62 and/or controller along the harness 40 to an end of the light strip 22. Any of various strap attachment features 66 are used to couple the power cable 64 to the harness 40. The controller includes a waterproof switch, button, lever, plug, or the like and attaches to the battery 62 or to the harness 40. In at least some embodiments, the controller not only turns the light strip 22 on and off, it controls further functionality, such as placing the light strip 22 in a strobe mode, an SOS mode, or the like. In an embodiment in which the LED lights are capable of producing more than one color of light, the controller may also control such color change.

Figure 5:
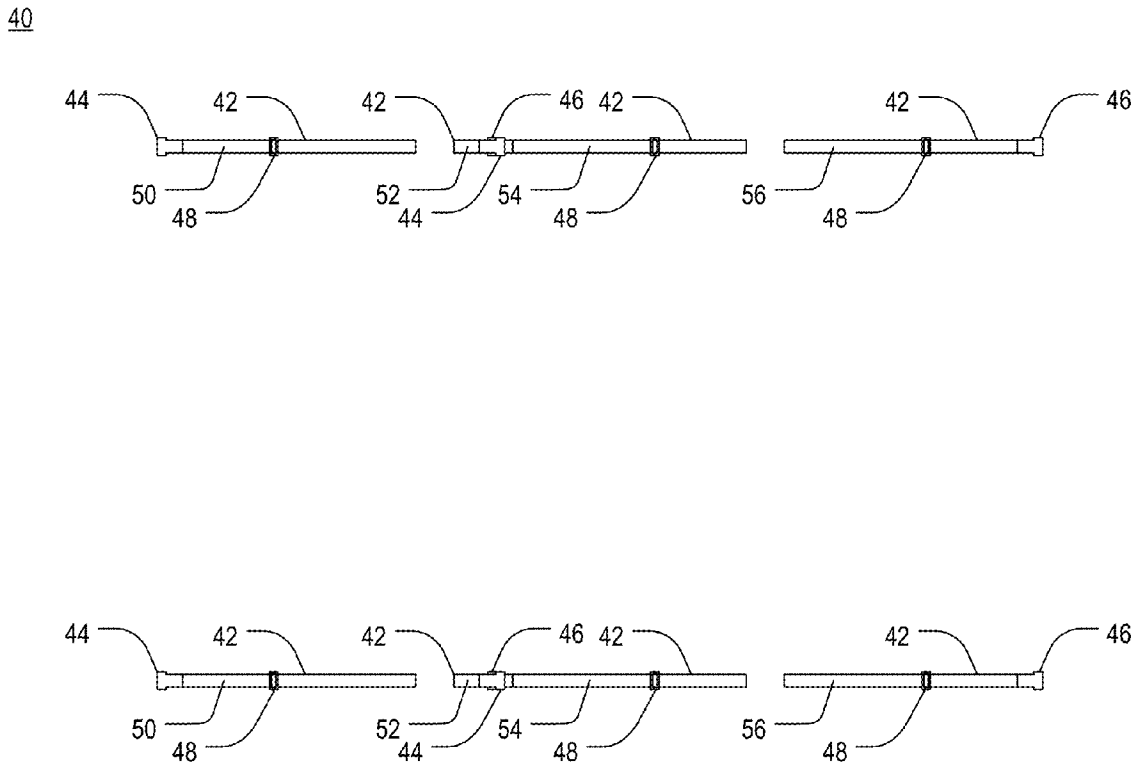
FIG. 5 is a partially schematic top view of the harness of FIG. 1.

FIG. 5 is a partially schematic top view of the harness 40 of FIG. 1. As shown therein, the harness 40 includes a plurality of flexible straps 42, male and female buckles 44,46 or other couplers at the ends of the straps 42, and a plurality of adjustment fittings 48. In the illustrated embodiment, there are a total of eight straps 42, including two "first" straps 50, two "second" straps 52, two "third" straps 54, and two "fourth" straps 56. The length of at least some, and preferably all, of the flexible straps 42 may be adjusted via the adjustment fittings 48, which may be conventional in nature. In at least some embodiments, the flexible straps 42 are each produced from a length of polypropylene webbing that is attached to a harness attachment point 26 at one end by folding and stitching the webbing into a loop. In other embodiments, the straps 42 are removably attached to the harness attachment points 26. Other materials or devices suitable for use include nylon straps, rubber straps, elastic nylon webbing, cinching straps, and the like.

At the other end of each strap 42 is a male or female coupler 44,46. In order to facilitate assembly, some straps 42 include "male" couplers 44, while others include "female" couplers 46. In particular, the first harness straps 50 include "male" couplers 44, the second harness straps 52 include "female" couplers 46, the third harness straps 54 include "male" couplers 44, and the fourth harness straps 56 include "female" couplers 46. Such an arrangement facilitates the use of each of the two light units 20 by itself (i.e., without the other light unit 20), but it will be appreciated that other arrangements are likewise possible. Furthermore, the separate use of the two light units 20 may also be facilitated by the use of interchangeable "gender-neutral" couplers.

Figure 6:
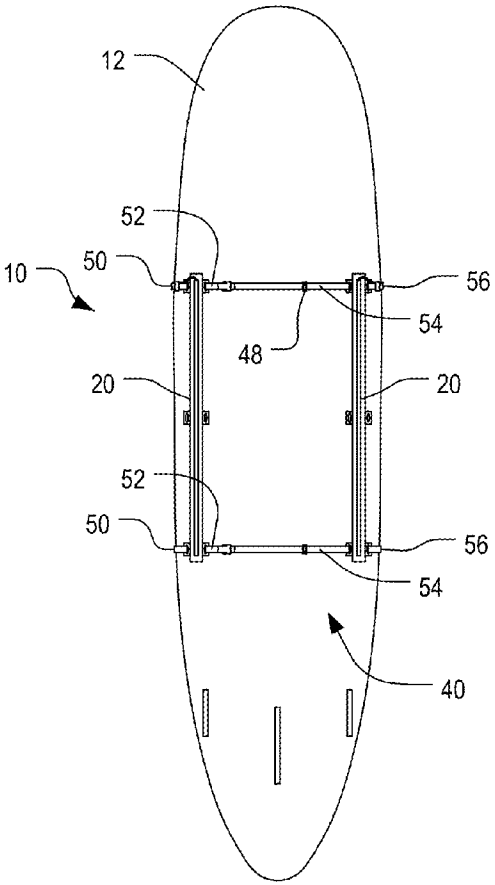
FIGS. 6 and 7 are a bottom view and a top view, respectively, of the submersible lighting system of FIG. 1 installed on a paddleboard.
Figure 7:
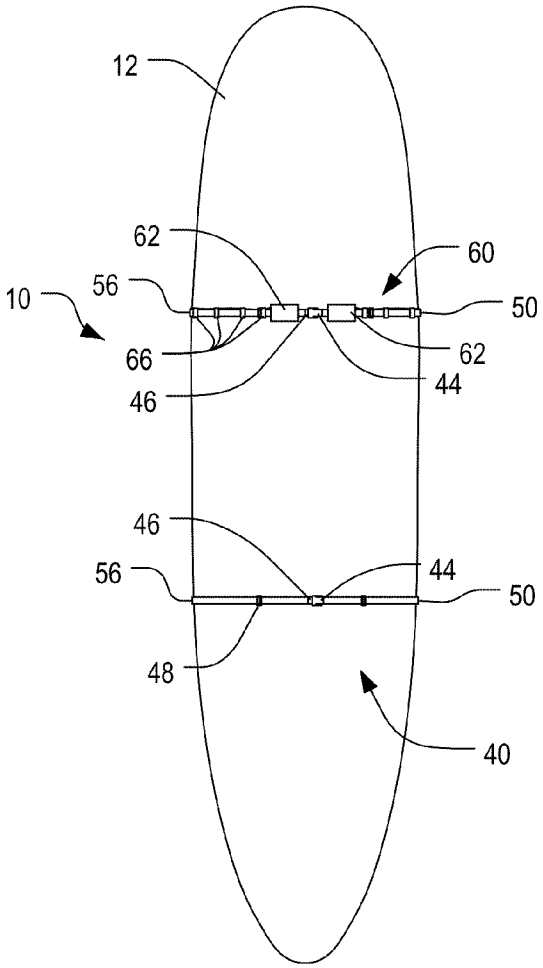

The system 10 of FIG. 1 may be installed on any of a variety of small watercraft. In particular, the lighting system 10 is preferably intentionally designed so that the light units 20 may be installed on the bottom of a small watercraft. For example, FIGS. 6 and 7 are a bottom view and a top view, respectively, of the submersible lighting system 10 of FIG. 1 installed on a paddleboard 12. The lengths of the second and third straps 52,54 are adjusted, using their respective adjustment fittings 48, so that the light units 20 are positioned in a desired location on the bottom of the paddleboard 12 or other watercraft. For example, in FIG. 6, the light units 20 are disposed near the outer (port and starboard) sides of the paddleboard 12. In this and at least some other installation dispositions, the long axis of the rail 24 is oriented along the length of the paddleboard 12. Further, in this and at least some other installation dispositions, the each light unit 20 is positioned closer to the side of the paddleboard 12 than to the center line of the paddleboard 12. As shown in FIG. 7, first and fourth straps 50,56 are wrapped around the sides of the watercraft 12 and over the top, where the buckles or other couplers 44,46 at their ends may be connected together. The adjustments fittings 48 of the first and fourth adjustment straps 50,56 are adjusted so that the harness 40 as a whole fits tightly around the watercraft 12. When sufficient force is supplied, the semi-rigid rails 24 are caused to flex slightly so as to fit or mold their shape to that of the bottom of the watercraft 12. This flexing also provides additional force pinning the rails 24 to the watercraft 12.

Each controller is preferably adjusted to as to be positioned on top of the watercraft 12. If the batteries 62 are separate from their respective controllers, it may likewise be preferable to adjust the position of each battery 62 to place it on top of the watercraft 12 as well. The power cables 64 are preferably arranged so as to avoid any loose portion thereof that might catch on an underwater obstruction or the like. Clips or other strap attachment features 66 may be utilizes to hold the cables 64 in place.

With the batteries 62 charged, the paddleboard 12 or other watercraft may then be utilized to provide underwater light as desired. Such use may, for example, take place at night or at other times of limited ambient light. In at least some embodiment, the controller may be manipulated while the watercraft 12 is in use; that is, when a user is riding or otherwise using the watercraft 12 on the water. In some embodiments, the controller may additionally or alternatively be manipulated before using the watercraft 12; that is, before the user boards, rides or otherwise uses the watercraft 12 on the water.

Figure 8:
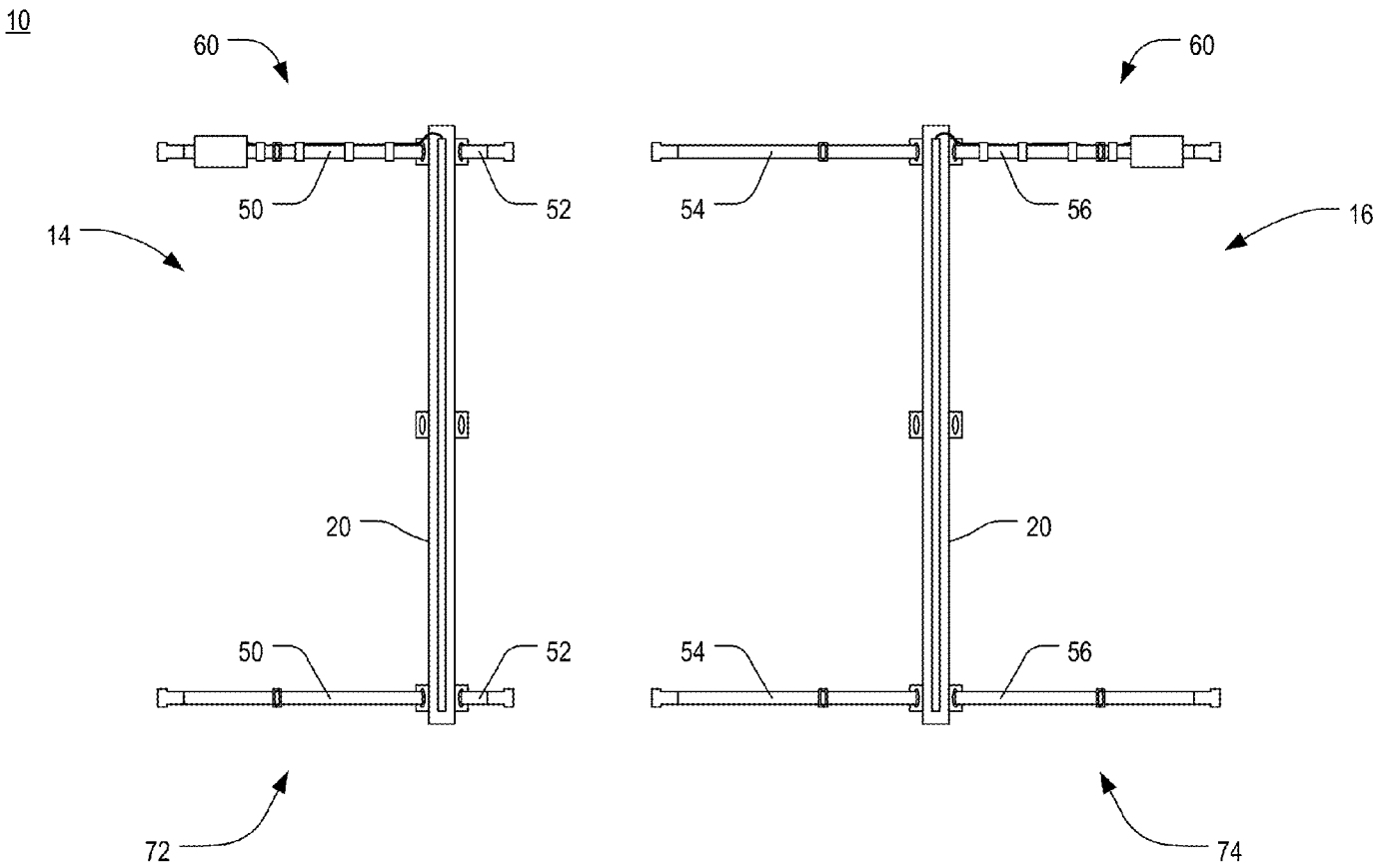
FIG. 8 is a partially schematic top view of the submersible lighting system of FIG. 1, shown in an alternate configuration.

FIG. 8 is a partially schematic top view of the submersible lighting system 10 of FIG. 1, shown in an alternate configuration. As shown therein, the collection of components of the system 10 of FIG. 1 may be divided approximately in half to produce two separate submersible light systems 14,16. In particular, a first light system 14 includes one light unit 20, a first harness 72, and a power supply system 60, and a second light system 16 includes one light unit 20, a second harness 74, and a power supply system 60. The two individual systems 12,14 of FIG. 8, which are similar except for their respective harnesses 72,74, may each be used separately. The first harness 72 includes the "first" and "second" harness straps 50,52, while the second harness 74 includes the "third" and "fourth" harness straps 54,56. The first system 14 may be attached to a watercraft or other apparatus by wrapping its harness 72 around the apparatus and connecting the male couplers 44 of the first straps 50 to the female couplers 46 of the second straps 52, while the second system 16 may be attached to a watercraft or other apparatus by wrapping its harness 74 around the apparatus and connecting the male couplers 44 of the third straps 54 to the female couplers 46 of the fourth straps 56.

Figure 9:
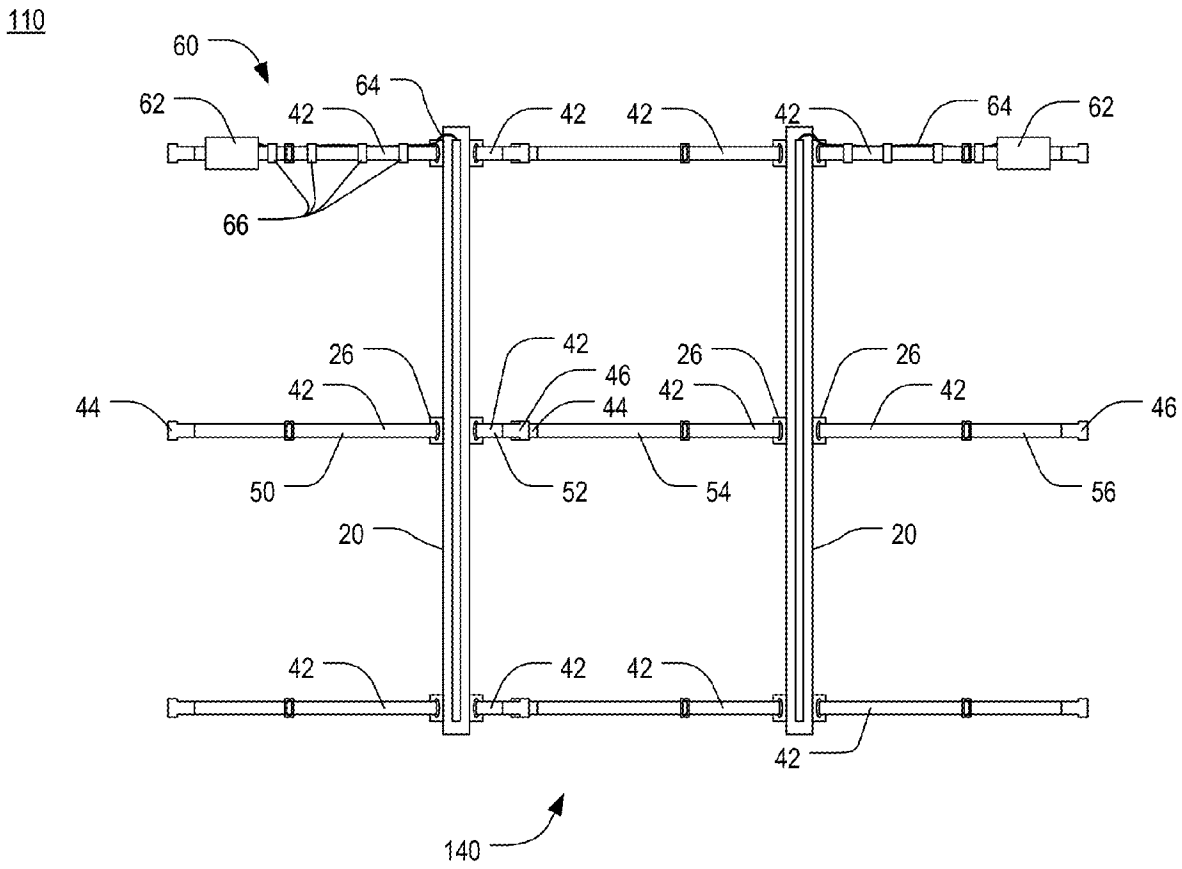
FIG. 9 is a partially schematic top view of a submersible lighting system for small watercraft in accordance with a second preferred embodiment of the present invention.

FIG. 9 is a partially schematic top view of a submersible lighting system 110 for small watercraft in accordance with a second preferred embodiment of the present invention. Like the system 10 of FIG. 1, the lighting system 110 of FIG. 9 includes a pair of light units 20, a harness 140, and a pair of power supply systems 60. The light units 20 and power supply systems 60 are similar to those of the system of FIG. 1. The harness 140 includes all of the components of the harness 40 of FIG. 1, but also includes an additional set of straps 42, male and female buckles 44,46 or other couplers at the ends of the straps 42, and adjustment fittings 48. The straps 42 are removably attached to the harness attachment points 26 that were unused in the system 10 of FIG. 1. Thus, in many respects, the alternate system 110 of FIG. 9 is simply the system 10 of FIG. 1 with an additional strap assembly for providing greater stability and retention capabilities. Furthermore, it will be appreciated that additional strap assemblies may likewise be provided. Likewise, additional harness attachment points 26 may be provided in order to provide still further flexibility in attaching any of the strap assemblies to a watercraft.

It will be appreciated that in addition to arrangements and/or embodiments wherein a harness 40,140, and/or elements of such a harness, and/or a harness modeled on such a harness, is utilized to retain two separate light units 20 against the bottom of a watercraft 12, a harness 40,140, and/or elements of such a harness, and/or a harness modeled on such a harness, may alternatively be utilized to retain only a single light unit 20 against the bottom of a watercraft 12 or three or more light units 20 against the bottom of a watercraft 12. One or more such arrangements and/or embodiments may be described and/or illustrated herein. Further, in at least some embodiments, any of the harnesses or harness types referred to hereinabove may additionally or alternatively be utilized to retain such light units 20 on one or both sides of the watercraft 12, or to the top of the watercraft 12, and one or more such arrangements and/or embodiments may be described and/or illustrated herein. Still further, in at least some embodiments, any of the harnesses or harness types referred to hereinabove may additionally or alternatively be utilized to retain alternative light units on the bottom, sides, or top of the watercraft 12, and one or more such arrangements and/or embodiments may be described and/or illustrated herein.

Figure 10:
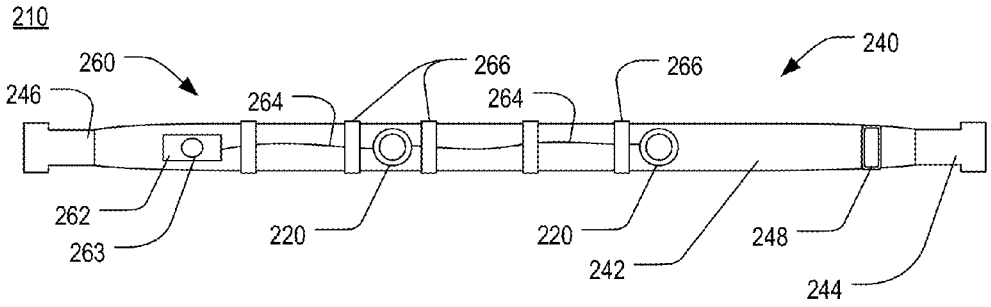
FIG. 10 is a schematic top view of a submersible lighting system for small watercraft in accordance with a third preferred embodiment of the present invention.

FIG. 10 is a schematic top view of a submersible lighting system 210 for small watercraft in accordance with a third preferred embodiment of the present invention. As shown therein, the lighting system 210 includes a pair of light units 220, a harness 240, and a power supply system 260. Each of these elements will be described in greater detail hereinbelow.

Each light unit 220 is attached or mounted upon the harness 240. The size of each light unit 220 corresponds to that of the harness 240. In at least some embodiments, the light units 220 may utilize LED lights. In some embodiments, the light produced is a bright white light, but other colors of light may be produced in other embodiments.

The power supply system 260 includes a battery 262, a controller 263, a power cable 264, and a plurality of strap attachment features 266 to couple the battery 262 and cable 264 to the harness 240. The battery 262 provides the power required by one of the light strips. In some other embodiments, a single battery may be used to power both light strips, but the use of two batteries makes it possible to separate the system into two separate subsystems as further described hereinbelow. The battery or batteries 262 may be alkali batteries, lithium ion batteries, nickel-metal hydride batteries, or the like. Each battery 262 is preferably waterproof and/or is contained within a watertight container, and has a waterproof connector to the power cable 264. The battery 262 is carried on the harness 240 by one or more sleeve, strap, or the like that may be incorporated into the harness design. In at least some embodiments, the battery 262 is easily removable or detachable from the harness 240 in order to facilitate recharging or replacement. The power cable 264 is routed from the battery 262 and/or controller 263 along the harness 240 to the light units 220. Any of various strap attachment features 266 are used to couple the power cable 264 to the harness 240. The controller 263 includes a waterproof switch, button, lever, plug, or the like and attaches to the battery 262 or to the harness 240. In at least some embodiments, the controller 263 not only turns the light units 220 on and off, it controls further functionality, such as placing the light units 220 in a strobe mode, an SOS mode, or the like. In an embodiment in which the light units 220 are capable of producing more than one color of light, the controller 263 may also control such color change.

The harness 240 includes a flexible strap 242, male and female buckles 244,246 or other couplers at the ends of the strap 242, and one or more adjustment fittings 248. The length of the flexible strap 242 may be adjusted via the adjustment fittings 248, which may be conventional in nature. In at least some embodiments, the flexible strap 242 is produced from a length of polypropylene webbing. The light units 220 may be permanently attached to the strap 242, or may be removably attached via any of a variety of couplings.

Figure 11:
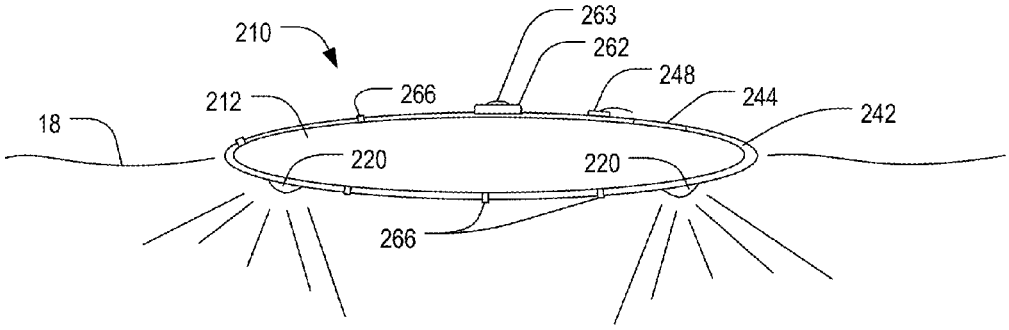
FIG. 11 is a schematic front view of the submersible lighting system of FIG. 10 installed on a surfboard.

The system 210 of FIG. 10 may be installed on any of a variety of small watercraft. In particular, the lighting system 210 is preferably intentionally designed so that the light units 220 may be installed on the bottom of a small watercraft. For example, FIG. 11 is a schematic front view of the submersible lighting system 210 of FIG. 10 installed on a surfboard 212. The length of the strap 242 is adjusted, using the adjustment fittings 248, so that the light units 220 are positioned in a desired location on the bottom of the surfboard 212 or other watercraft. For example, in FIG. 11, the light units 220 are disposed near the outer (port and starboard) sides of the surfboard 212. The strap 242 is wrapped around the sides of the watercraft 212 and over the top, where the buckles or other couplers 244,246 may be connected together. The adjustments fittings 248 are adjusted so that the harness 240 as a whole fits tightly around the watercraft 212.

The controller 263 is preferably adjusted to as to be positioned on top of the watercraft 212. If the battery 262 is separate from the controller, it may likewise be preferable to adjust the position of the battery 262 to place it on top of the watercraft 212 as well. The power cable 264 is preferably arranged so as to avoid any loose portion thereof that might catch on an underwater obstruction or the like. Clips or other strap attachment features 266 may be utilizes to hold the cable 264 in place.

With the battery 262 charged, the surfboard 212 or other watercraft may then be utilized to provide underwater light as desired. Such use may, for example, take place at night or at other times of limited ambient light. In at least some embodiment, the controller 263 may be manipulated while the watercraft 212 is in use; that is, when a user is riding or otherwise using the watercraft 212 on the water 18. In some embodiments, the controller may additionally or alternatively be manipulated before using the watercraft 222; that is, before the user boards, rides or otherwise uses the watercraft 212 on the water 18.

Figure 12A:
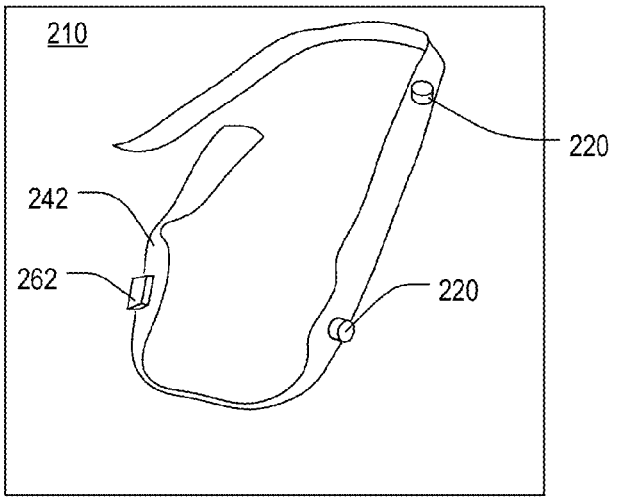
FIG. 12A is a pictorial illustration of the submersible lighting system of FIG. 10, shown prior to installation.
Figure 12B:
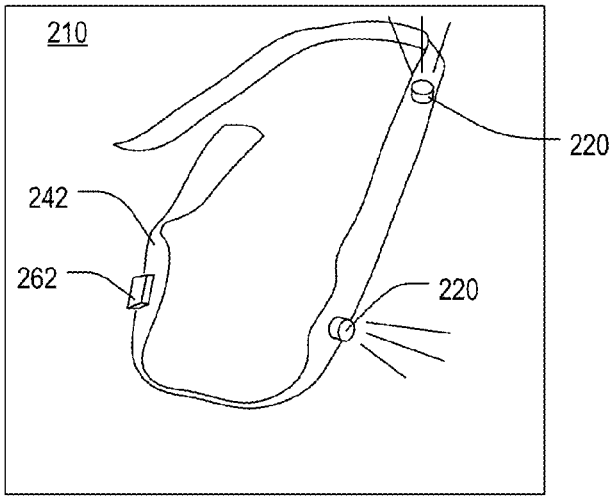
FIG. 12B is a pictorial illustration of the submersible lighting system of FIG. 12A, shown with the lights in their "on" state.
Figure 12C:
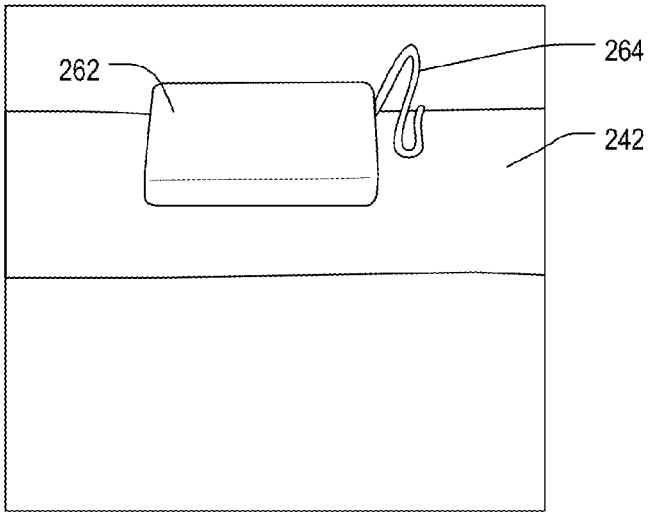
FIG. 12C is a pictorial illustration of the battery and controller of the submersible lighting system of FIG. 12A.
Figure 12D:
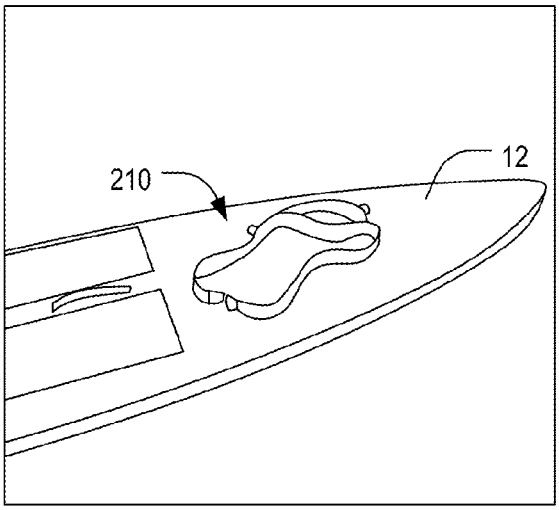
FIG. 12D is a pictorial illustration of the submersible lighting system of FIG. 10, shown prior to installation on a paddleboard.
Figure 12E:
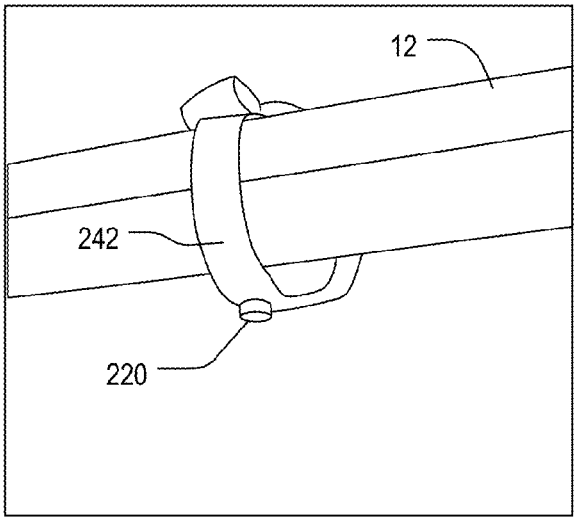
FIG. 12E is a pictorial illustration of the submersible lighting system being installed on the paddleboard of FIG. 12D.
Figure 12F:
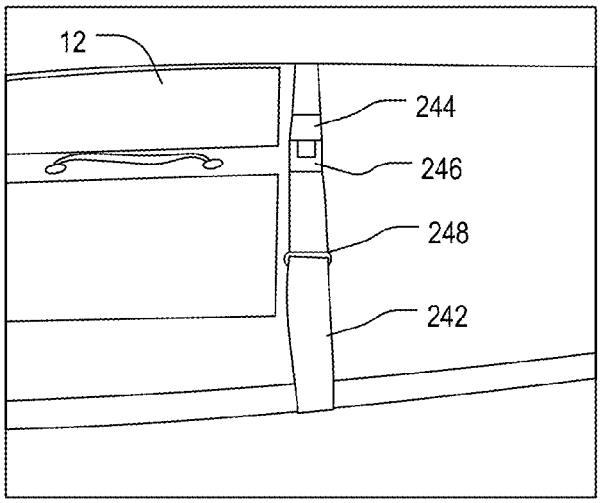
FIG. 12F is a pictorial illustration of the submersible lighting system in an installed state on the paddleboard of FIG. 12D.

FIGS. 12A-12F are additional pictorial illustrations of the submersible lighting system 210 of FIG. 10 and its use with a surfboard. In particular, FIG. 12A is a pictorial illustration of the submersible lighting system 210 of FIG. 10, shown prior to installation; FIG. 12B is a pictorial illustration of the submersible lighting system 210 of FIG. 12A, shown with the lights in their "on" state; FIG. 12C is a pictorial illustration of the battery 262 and controller 263 of the submersible lighting system 210 of FIG. 12A; FIG. 12D is a pictorial illustration of the submersible lighting system 210 of FIG. 10, shown prior to installation on a paddleboard 12; FIG. 12E is a pictorial illustration of the submersible lighting system 210 being installed on the paddleboard 12 of FIG. 12D; and FIG. 12F is a pictorial illustration of the submersible lighting system 210 in an installed state on the paddleboard 12 of FIG. 12D.

Figure 13:
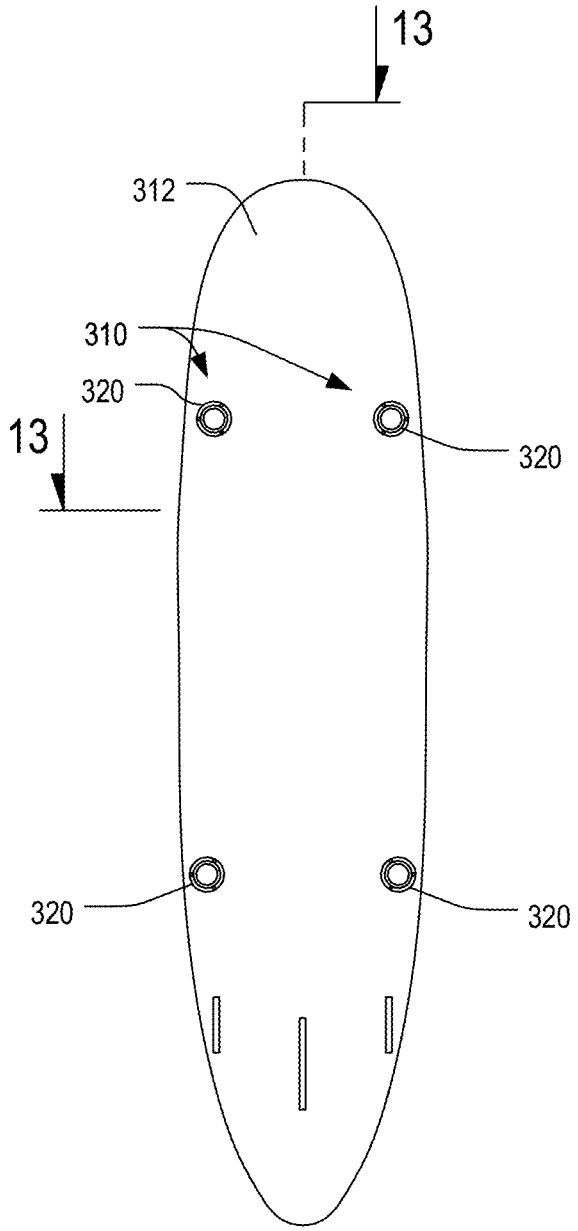
FIG. 13 is a bottom view of paddleboard having a submersible lighting system in accordance with a fourth preferred embodiment of the present invention.
Figure 14:
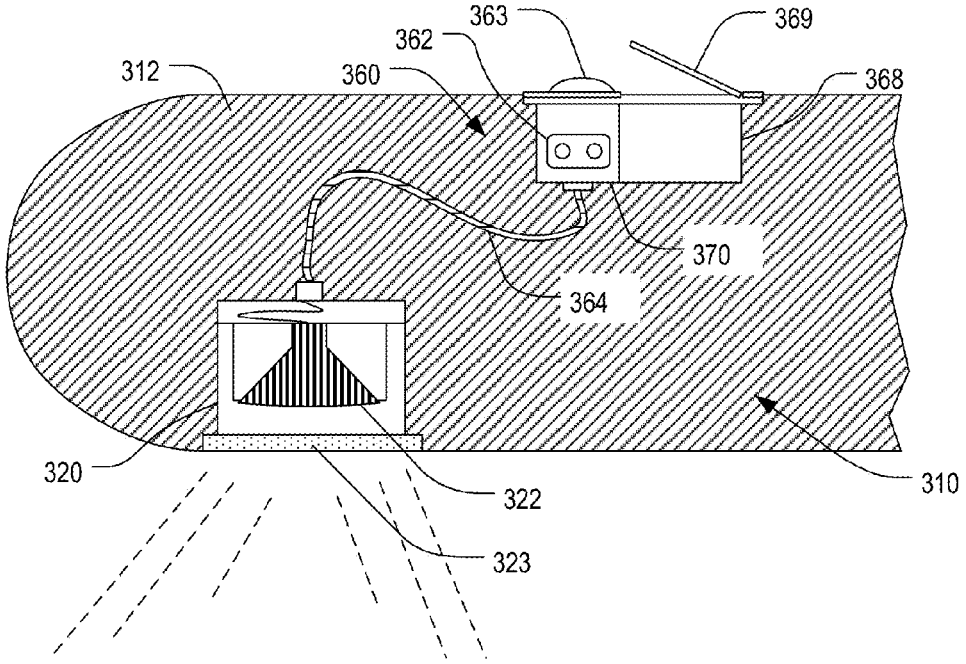
FIG. 14 is a schematic fragmentary front cross-sectional view of the paddleboard of FIG. 13.

FIG. 13 is a bottom view of paddleboard 312 having a submersible lighting system 310 in accordance with a fourth preferred embodiment of the present invention, and FIG. 14 is a schematic fragmentary front cross-sectional view of the paddleboard 312 of FIG. 13. As shown therein, the lighting system 310 includes a plurality of light units 320 and a power supply system 360. Each light unit 320 includes a light source 322, such as an LED light, and a protective lens 323, and is recessed within the paddleboard 312 or otherwise mounted so as to minimize its protrusion above the surface thereof, thereby avoiding or minimizing drag. Similarly, the components of the power supply system 360, which include a battery 362, a controller 363, and power cables 364, are recessed within the paddleboard 312 or otherwise mounted so as to minimize their protrusion above the surface thereof. A recessed compartment 368 may also be provided for storage of keys, mobile phone, credit card, cash, identification, or the like. A watertight lid 369 or other access port may be provided for the compartment 368. The battery 362 may itself be waterproof, and/or the battery 362 may be contained within the compartment 368 or within its own watertight container 370.

The controller 363, which may include a switch, a button, a lever, a plug, or the like, provides functionality similar to that which has been described previously. In some embodiments, the controller 363 is accessible from the surface of the paddleboard 312; in other embodiments, the controller 363 is accessible through the compartment 368 and is, itself, protected by the lid 369 or other access port.

Figure 15:
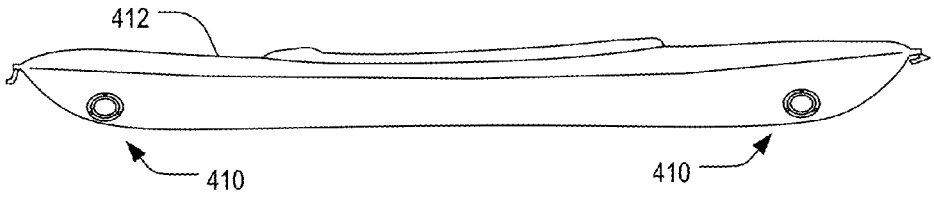
FIG. 15 is a side perspective view of a kayak having a submersible lighting system in accordance a fifth preferred embodiment of the present invention.
Figure 16:
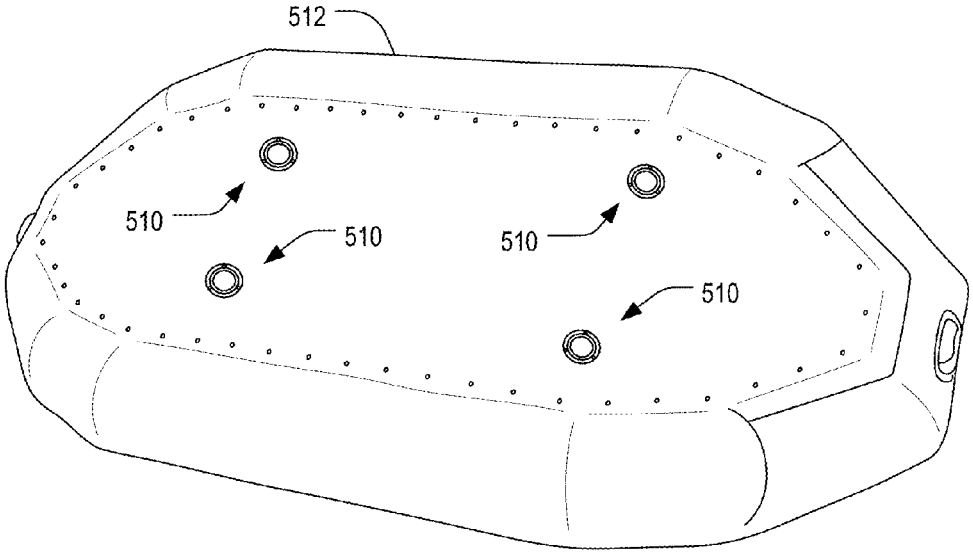
FIG. 16 is a bottom perspective view of an inflatable raft having a submersible lighting system in accordance with a sixth preferred embodiment of the present invention.

FIG. 15 is a side perspective view of a kayak 412 having a submersible lighting system 410 in accordance a fifth preferred embodiment of the present invention, and FIG. 16 is a bottom perspective view of an inflatable raft 512 having a submersible lighting system 510 in accordance with a sixth preferred embodiment of the present invention. The submersible lighting systems 410,510 of FIGS. 15 and 16 are similar to those of FIGS. 13 and 14, but adapted for use with a kayak 412 and inflatable raft 512, respectively. As represented by the watercraft 312,412,512 of FIGS. 13, 15, and 16, the various submersible lighting systems described and illustrated herein may be used with a wide variety of small watercraft, including paddleboards, surfboards, sailboards, kayaks, canoes, rafts, and the like.

Submersible lighting systems described herein may additionally or alternatively be attached via suction devices, adhesive tape, fasteners, and the like, although each may have its own advantages and/or disadvantages.

The various submersible lighting systems described and illustrated herein may be used to illuminate the water surface and/or the underwater area directly below or adjacent the watercraft, thereby facilitating the viewing of marine life, improving navigation, and enhancing the safety of the user and those around him or her.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. An underwater light-equipped watercraft system comprising:

a watercraft having a bottom surface that is disposed underwater when the watercraft is used in the water; and a removable submersible lighting system, including a harness and a light unit coupled to the harness, wherein the harness is removably mounted around at least a portion of the watercraft such that the light unit is disposed against the bottom surface of the watercraft;

wherein the watercraft further has a top surface, and wherein the harness is removably mounted around the top surface of the watercraft; and wherein the harness includes one or more straps, and wherein the harness is removably mounted around the top surface of the watercraft by extending the one or more straps around the top surface of the watercraft.

2. The underwater light-equipped watercraft system of claim 1, wherein each of the one or more straps includes a length of polypropylene webbing.

3. The underwater light-equipped watercraft system of claim 1, wherein the removable submersible lighting system further comprises a power supply system providing electricity to the light unit.

4. The underwater light-equipped watercraft system of claim 3, wherein the power supply system includes a controller, operable to turn the light unit on and off, disposed on the top surface of the watercraft.

5. The underwater light-equipped watercraft system of claim 4, wherein the controller is electrically connected to the light unit via at least one electrical wire carried by the harness from the controller to the light unit.

6. The underwater light-equipped watercraft system of claim 3, wherein the watercraft is a surfboard.

7. The underwater light-equipped watercraft system of claim 3, wherein the watercraft is a kayak.

8. The underwater light-equipped watercraft system of claim 3, wherein the watercraft is a paddleboard.

9. The underwater light-equipped watercraft system of claim 3, wherein the watercraft is a sailboard.

10. An underwater light-equipped watercraft system comprising:

a watercraft having a bottom surface that is disposed underwater when the watercraft is used in the water; and a removable submersible lighting system, including a harness and a light unit coupled to the harness, wherein the harness is removably mounted around at least a portion of the watercraft such that the light unit is disposed against the bottom surface of the watercraft;

wherein the light unit includes an elongated body whose long axis is oriented along the length of the watercraft.

11. The underwater light-equipped watercraft system of claim 10, wherein the elongated body of the light unit includes two opposed ends, and wherein each of the two opposed ends is coupled to the harness.

12. The underwater light-equipped watercraft system of claim 10, wherein the watercraft includes a side, wherein the bottom surface of the watercraft defines a centerline, wherein the elongated body of the light unit is disposed between the centerline and the side of the watercraft, and wherein the elongated body of the light unit is disposed closer to the side of the watercraft than to the centerline.

13. The underwater light-equipped watercraft system of claim 12, wherein the side of the watercraft is a port side, wherein the light unit is a first light unit and is disposed adjacent the port side of the watercraft, wherein the watercraft further includes a starboard side, and wherein the lighting system includes a second light unit that is disposed adjacent the starboard side of the watercraft, closer to the starboard side of the watercraft than to the centerline.

14. The underwater light-equipped watercraft system of claim 10, wherein the light unit includes a light strip extending along the long axis of the elongated body.

15. The underwater light-equipped watercraft system of claim 14, wherein the elongated body includes a channel extending along its long axis, and wherein the light strip is disposed within the channel.

16. The underwater light-equipped watercraft system of claim 14, wherein the light strip includes a row of LED lights covered by a hard clear coat.

17. The underwater light-equipped watercraft system of claim 10, wherein the removable submersible lighting system further includes a power supply system providing electricity to the light unit.

18. The underwater light-equipped watercraft system of claim 10, wherein the watercraft further has a top surface, and wherein the harness is removably mounted around the top surface of the watercraft.

19. An underwater light-equipped watercraft system comprising:

a watercraft having a bottom surface that is disposed underwater when the watercraft is used in the water; and a removable submersible lighting system, including a harness and a light unit coupled to the harness, wherein the harness is removably mounted around at least a portion of the watercraft such that the light unit is disposed against the bottom surface of the watercraft;

wherein the harness includes one or more strap sections forming a single continuous loop around the watercraft, wherein the lighting system includes two light units carried entirely by the single continuous loop, and wherein the two light units are separated from one another such that one light unit is disposed adjacent a port side of the watercraft and the other light unit is disposed adjacent a starboard side of the watercraft.

20. The underwater light-equipped watercraft system of claim 19, wherein the removable submersible lighting system further includes a power supply system providing electricity to the light unit.

* * * * *